United States Patent [19]

Bud et al.

[11] 4,028,530

[45] June 7, 1977

[54] COUNTING DEVICES

[75] Inventors: Hans Bud, London; Peter Alway, Bushey, both of England

[73] Assignee: Hans Bud, London, England

[22] Filed: May 16, 1975

[21] Appl. No.: 578,342

[30] Foreign Application Priority Data

May 22, 1974 United Kingdom ..... 22945/74

[52] U.S. Cl. ..... 235/144 HC; 235/133 R; 235/144 SP

[51] Int. Cl.[2] ..... G06C 15/42

[58] Field of Search ..... 235/133 R, 134, 144 R, 235/144 HC, 144 SM, 144 SP

[56] References Cited

UNITED STATES PATENTS

| | | | |
|---|---|---|---|
| 3,244,368 | 4/1966 | Juhas | 235/144 HC |
| 3,357,637 | 12/1967 | Stautmeister | 235/144 HC |
| 3,494,549 | 2/1970 | Spath | 235/144 HC |
| 3,878,732 | 4/1975 | Kubler | 235/144 HC |
| 3,912,910 | 10/1975 | Ochi | 235/144 SP |

*Primary Examiner*—Robert K. Schaefer
*Assistant Examiner*—Vit W. Miska
*Attorney, Agent, or Firm*—Browdy and Neimark

[57] ABSTRACT

A counting device of the kind having coaxial number wheels each with a reset cam and transfer pinions mounted on a shaft which is displaceable relatively to the number wheels the pinions being located between successive number wheels with each pinion meshing with gear teeth on an adjacent number wheel and adapted to engage drive means on the other adjacent number wheel so as partially to rotate the number wheel with which it is in mesh. Reset fingers are provided which are together rotatable about a common axis respectively to engage with the reset cams to reset the number wheels, the reset fingers and transfer pinions being located, prior to resetting, respectively out of engagement with the reset cams and in engagement with the gear teeth on the number wheels. A reciprocably movable actuating member is also provided to effect resetting of the number wheels during movement in one sense and upon movement in the reverse sense is repositioned for subsequent resetting action. Flexible members are provided which are disposed to be out of contact with the transfer pinions during counting operations of the device and located so as to be engaged respectively by the transfer pinions during reset operation of the actuating member thereby to reorientate the pinions and abutment means which engage and stress the flexible members after engagement thereof with the transfer pinions so that contact between the pinions and the flexible members is maintained until remeshing of the pinions with the number wheel gear teeth takes place, the flexible members thereafter disengaging from the pinions.

8 Claims, 13 Drawing Figures

COUNTING DEVICES

BACKGROUND OF THE INVENTION

This invention relates to counting devices and more particularly to such devices of the kind comprising a counter having coaxial rotatable number wheels, a reset cam provided with each number wheel to rotate therewith, transfer pinions, a shaft on which the transfer pinions are rotatably mounted and which is displaceable relatively to the number wheels, the pinions being disposed respectively intermediate successive number wheels, each pinion meshing with gear teeth on one of the number wheels adjacent thereto and adapted to engage drive means on the other number wheel during rotation of said other number wheel thereby partially to rotate said one of the number wheels, reset fingers together rotatable about a common axis to engage respectively with the reset cams to reset the number wheels, the reset fingers and the transfer pinions being located, prior to resetting, respectively out of engagement with the reset cams and in engagement with the gear teeth on the number wheels, and a reciprocably movable actuating member adapted to effect resetting of the number wheels during movement thereof in one sense by rotation of the reset fingers and upon movement in the reverse sense to be repositioned for subsequent resetting action.

Counter devices of the kind set forth are often provided with springs which engage gear teeth or bosses on the pinions, the bosses being formed with flats so that during resetting, the pinions, whilst disengaged, remain properly orientated for correct remeshing with the gear teeth of the number wheels. However, in some known arrangements, the springs remain in contact with the pinions even after re-engagement of the pinions and during counting operations giving rise to operating noise and increased torque requirements either or both of which are unacceptable for certain applications of the counter particularly in electrical and electronic equipment. In other known arrangements means are provided which, prior to disengagement of the transfer pinions during resetting, clamp the pinions and hold them correctly orientated for remeshing throughout the period that the transfer pinions are out of mesh with respect to the number wheel. Arrangements of this kind are mechanically complex and have undesirably high power requirements for resetting.

It is an object of the invention to provide a counter device in which the aforesaid disadvantages are overcome.

SUMMARY OF THE INVENTION

The present invention consists in a counter device of the kind set forth, wherein there are provided flexible members disposed to be out of contact with the transfer pinions during counting operations of the device and located so as to be engaged respectively by the transfer pinions subsequent to the disengagement of the transfer pinions from the number wheels during reset operation of the actuating member thereby to reorientate the pinions and abutment means which engage and stress the flexible members after engagement thereof with the transfer pinions so that contact between the pinions and the flexible members is maintained until remeshing of the pinions with the number wheel gear teeth takes place, the flexible members thereafter disengaging from the pinions.

Advantageously, the reset fingers are supported on a cradle having parallel end members extending transversely with respect to the number wheel axis and a longitudinal member connected therebetween and on which the reset fingers are mounted, the longitudinal member lying to one side of the pivotal axis of the end members and providing the abutment means which engage and stress the flexible members.

Preferably, on the side of one of the end members remote from the longitudinal member is an abutment and the actuating member is adapted during the resetting action thereof to engage said abutment to rotate the reset fingers respectively into engagement with the reset cams and to rotate the longitudinal member of the cradle into engagement with the flexible member so as to effect stressing thereof.

In one form of the invention the flexible members comprise a plurality of leaf springs secured on the body of the device and extending on the side of the transfer pinions remote from the number wheels.

BRIEF DESCRIPTION OF THE DRAWINGS

The invention will now be described, by way of example, with reference to the accompanying drawings in which.

DETAILED DESCRIPTION OF THE PREFERRED EMBODIMENTS

Figure 1:
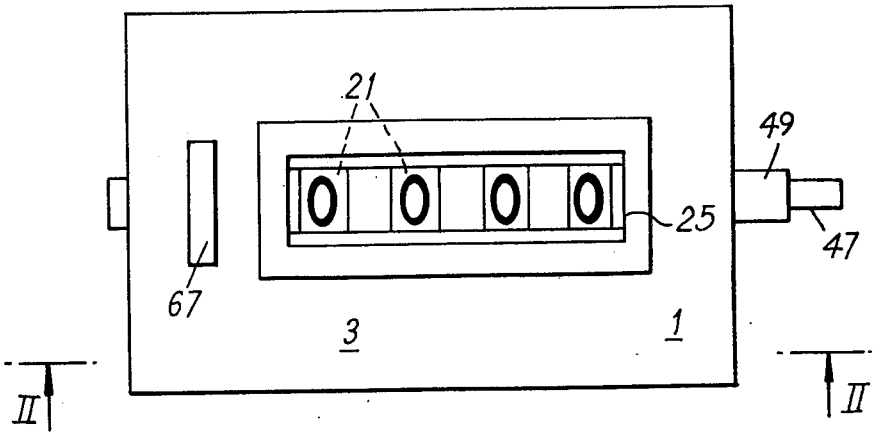
FIG. 1 is a plan view of an embodiment of a counter device according to the invention.
Figure 2:
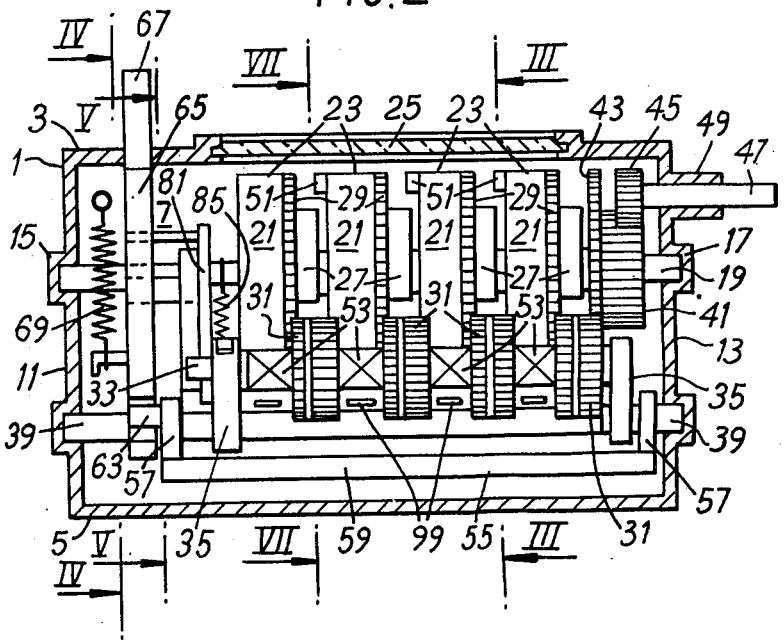
FIG. 2 is a sectional elevation on the line II—II of FIG. 1.
Figure 3:
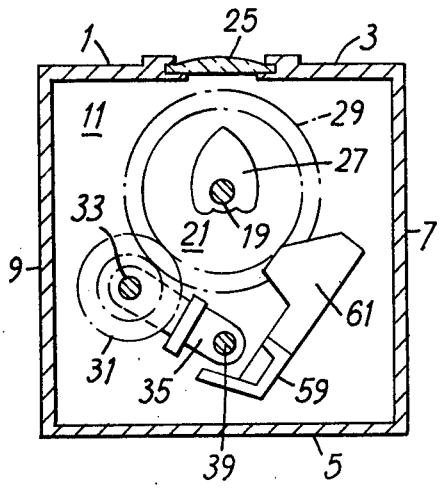
FIG. 3 is a cross-sectional view with certain parts omitted on the line III—III of FIG. 2.

Referring to the drawings, a counter device in the form of a decade counter comprises a body 1 of generally rectangular cross-section defined by upper and lower walls 3 and 5 upright side walls 7 and 9 and end walls 11 and 13. End walls 11 and 13 are formed with recesses 15 and 17 in which are journalled ends of a shaft 19 on which are freely rotatably mounted number wheels 21 each formed with a series of numbers on an outer cylindrical surface 23 thereof. In upper wall 3 is disposed an elongated window 25 through which a number on the part of each wheel immediately below the window can be observed. The wheels accordingly as viewed through window 25 provide a sequence of numbers which represent the count of the device.

On a side of each number wheel 21 is formed integrally therewith a coaxial reset cam 27 which is substantially heart shaped and outwardly of the cam is formed a ring 29 of gear teeth. The rings 29 of gear teeth each mesh with a pinion 31 freely rotatably mounted on a shaft 33 the ends of which are pivotally carried on respective arms 35 which remotely, from shaft 33 are respectively mounted on ends of a shaft 39 journalled in recesses in the end walls 11 and 13.

At an end of the row of number wheels 21 there is rotatably mounted on the number wheel shaft 19 a pair of coaxial gears 41 and 43 of different diameters which are formed in one and of which the smaller diameter gear 41 meshes with a pinion 45 on a shaft 47 which extends through a bearing 49 formed in end wall 13 to an external drive mechanism. The larger gear 43 meshes with pinion 31 at the corresponding end of the row of pinions on shaft 33 and the same pinion 31 engages the ring 29 of gear teeth on number wheel 21 adjacent the pair of gears 43 and 41. It will be apparent, accordingly, that as the external drive is operated to rotate pinion 45, gears 41 and 43 are rotated and pinion 31 in mesh which gear 43 thereby effects rotation of adjacent number wheel 21.

The faces of the number wheels which are opposed respectively to rings 29 of gear teeth each on an adjacent number wheel 21 are formed each with a tooth element 51 which at the completion of each revolution of the associated number wheel effects a partial rotation of the pinion 31 in mesh with the ring 29 of gear teeth on the adjacent number wheel 21 so that the number wheel rotates through one tenth of a revolution. Thus, in operation, successive wheels 21 from the gear pair 41 and 43 rotate stepwise one tenth of the rotation of the preceding wheel, the steps of rotation occurring on completion of a revolution of the preceding wheel.

Each of the pinions 31 is formed with a laterally extending boss 53 of square cross-section the purpose of which is hereinafter described.

The shaft 39 also has rotatably mounted thereon a cradle 55 having end members 57 rotatably engaged on shaft 39 and a longitudinal member 59 which extends between the end members. Extending from longitudinal member 59 are upwardly extending fingers 61 which upon rocking of cradle 55 respectively engage and rotate cams 27 to reset the number wheels 21. The end member 57 remote from gear pair 41 and 43 extends on opposite sides of the plane of symmetry of the device which contains the axes of shafts 19 and 39 and the fingers 61 are disposed to one side of the plane of symmetry. On the other side of the plane of symmetry, the end member 57 remote from gear pair 41 and 43 is provided with an abutment 63 which extends parallel with shaft 39 towards end wall 11.

The abutment 63 is engageable with actuating member 65 for resetting number wheels 21. Member 65 is in the form of an apertured slide which is flat and extends and is constrained for movement parallel with end walls 11 and 13. An upper end of member 65 projects through the upper housing wall 3 to afford reset button 67 which can be depressed to move member 65 against the action of a biassing spring 69 anchored at opposite ends thereof respectively to the housing and the member 65.

Figure 4:
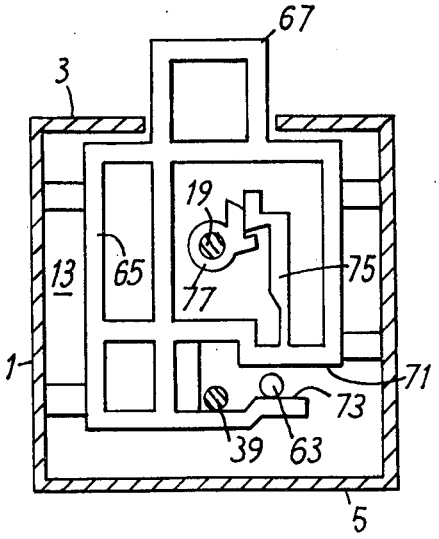
FIG. 4 is a sectional view with certain parts omitted on the line IV—IV of FIG. 2 prior to resetting operation.
Figure 5:
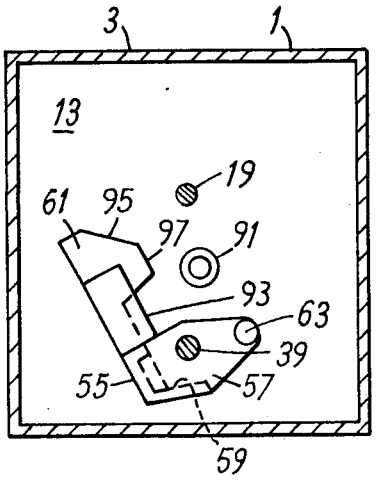
FIGS. 5 and 6 are sectional views each taken on the line V—V of FIG. 2 and each has parts omitted so as clearly to illustrate the relationship between certain elements of the counting device.
Figure 6:
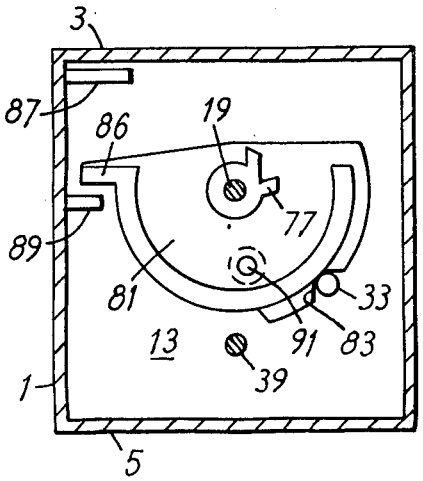

The abutment 63 projects between upper and lower jaws 71 and 73 formed integrally with actuating member 65 and in the uppermost position of the member 65 (see FIG. 4) jaw 71 is located a short distance above abutment 63 so that only after an initial movement of member 65 does the latter engage the abutment and cause rocking of cradle 55 to effect engagement between fingers 61 and cams 27. It will be noted that apertures in actuating member 65 prevent engagement of the member during reciprocation thereof with either of shafts 19 or 39.

The actuating member 65 is formed with an upstanding pawl 75 which can flex laterally in the plane of the member 65 and which in the uppermost position of member 65 engages a ratchet 77 on shaft 19. Movement of member 65 to effect resetting rotates ratchet 77 through a small angle, approximately 25° until the pawl is disengaged. During return movement of the actuating member, the stroke of which is about 3 mm, the influence of spring 69 effects re-engagement between ratchet 77 and pawl 75.

Mounted on shaft 19 for rotation with ratchet 77 is a cam element 81 in a cylindrical surface of which is a longitudinally extending groove 83 in which pinion shaft 33 is located, shaft 33 being biassed into engagement with groove 83 by a spring 85 anchored at opposite ends to shaft 19 and arm 35. On depression of actuating member 65 the rotation of ratchet 77 causes rotation of cam element 81 which displaces shaft 33 out of groove 83 on to the periphery of cam element 81 thereby to effect disengagement of pinions 31 from number wheels 21 before fingers 61 of cradle 55 can engage cam 27 prior to rocking of cradle 55.

Figure 11:
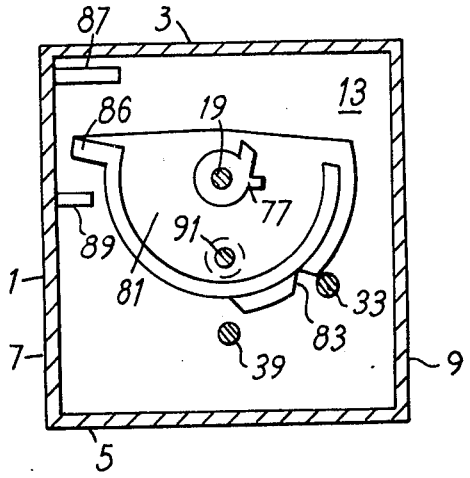
FIG. 11 is a view similar to FIG. 6 showing a position of parts of the device during resetting thereof.
Figure 13:
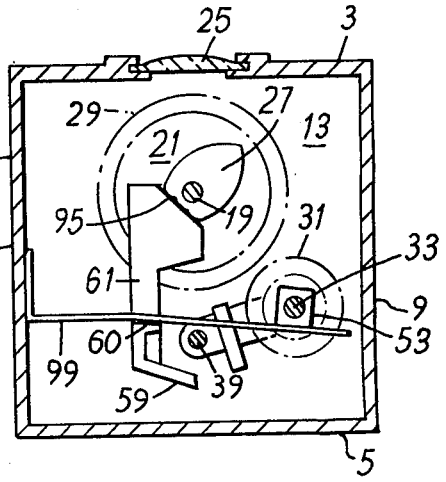

The cam element 81 is formed with an abutment 86 which upon rotation of the cam element in opposite senses may engage respective stops 87 and 89 on the housing 1 to limit travel of the cam element and thereby prevent its moving to a position in which it is out of synchronisation with other parts of the mechanism. Also, on cam element 81 is a boss 91 which upon rotation of cam element 81 is engaged by an abutment 93 provided on cradle 55. Engagement between boss 91 and abutment 93 reverses rotation of cam element 81 until fingers 61 engaging cams 27 have moved number wheels 21 to the reset position shown in FIG. 13. Cam element 81 is then in the position shown in FIG. 11 to allow spring 85 to rotate cam element 81 to its original position and pinion shaft 33 to be restored into groove 83.

Throughout the resetting operation contact as will be apparent is maintained between shaft 33 and the cam element 81 either in groove 83 or at the cam element periphery.

It will be noted that each finger 61 is formed with faces 95 and 97 one or other of which engages the corresponding cam 27 during resetting. The disposition of faces 95 and 97 ensures that whatever the point of engagement of cam 27 with the faces, finger 61 exerts a force on cam 27 which will cause the required cam rotation so that jamming of the cam and finger is prevented.

Figure 7:
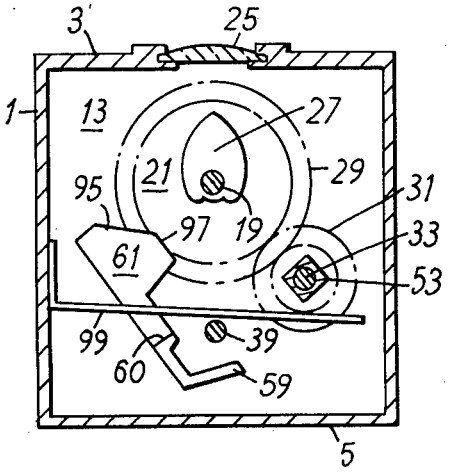
FIGS. 7 and 8 are sectional views on the line VII—VII showing different possible positions of parts of the device prior to and during resetting operation.
Figure 8:
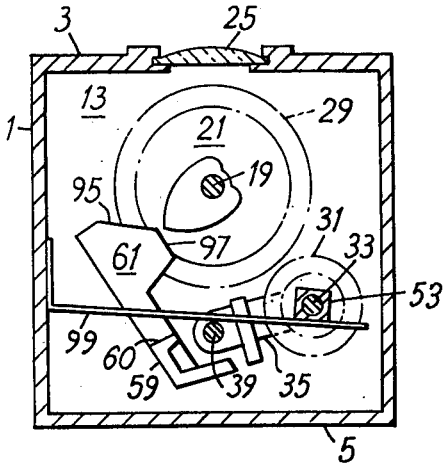
Figure 9:
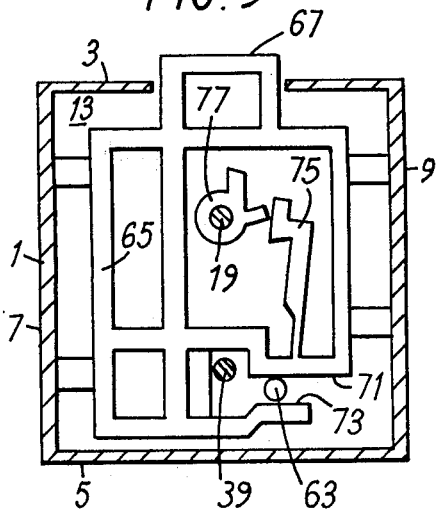
FIG. 9 is a view similar to FIG. 4 but showing a position of parts during resetting of the device.
Figure 10:
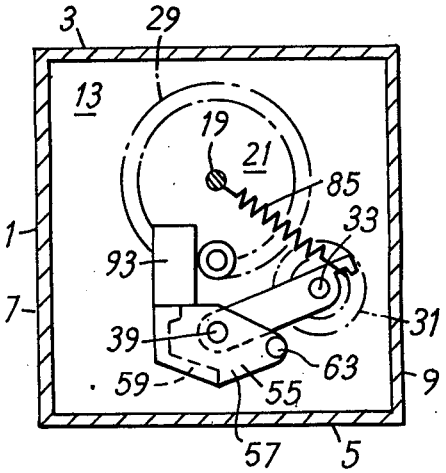
FIG. 10 is a view taken out in line V—V of FIG. 2 of certain parts of the device in a position reached during resetting of the device.
Figure 12:
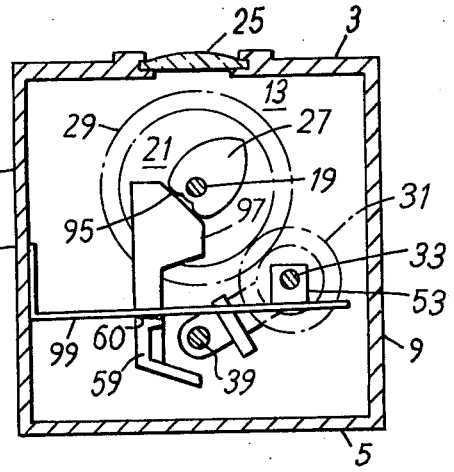
FIGS. 12 and 13 are views similar to FIGS. 7 and 8 illustrating parts of the device at different times during resetting thereof.

When, during resetting, shaft 33 is swung to disengage pinions 31 from wheels 21, bosses 53 on pinions 31 engage respective leaf springs 99 which are secured at corresponding ends thereof to housing side wall 7 and which extend across the housing towards wall 9. Upon engagement between springs 99 and bosses 53 the pinions rotate freely until one of the four flat faces of each boss contacts the corresponding spring 99. The pinions are thereby reorientated to ensure proper re-engagement thereof with the gear rings 29. It will be noted that when cradle 55 has been fully rocked during resetting to the position shown in FIG. 12 or 13, the top side 60 of longitudinal cradle member 59 engages the underside of leaf springs 99 between wall 7 and the point of engagement of the springs and the bosses 53 so that the springs are stressed to ensure that when, upon reversal of the cam element 81 and consequent movement back of shaft 33 into groove 83, the springs maintain engagement with bosses 53 until pinions 31 mesh with gear rings 29 (see FIG. 12). In this way correct orientation of the pinions is maintained throughout their return travel into mesh with gear rings 29 after which meshing and upon release of actuating member 65, causing return of cradle 55, the springs 99 flex out of contact with the bosses 53 and assume their original position as shown in FIG. 7.

The overall resetting operation of the mechanism can now be appreciated. Upon depressing button 67 of the actuating member the pawl 75 rotates ratchet 77 and therefore cam element 81 so that pinions 31 are driven out of mesh with gear rings 29 and bosses 53 engage springs 99 properly to orientate the pinions irrespective of their angular position at the time of disengagement from gear rings 29. Spring 85 is slightly extended and maintains pinion shaft 33 biassed towards cam element 81. On continued depression of button 67 jaw 71 engages abutment 63 to rock cradle 55 and the pawl 75 disengages from the ratchet 77. Cradle 55 is rocked until, through engagement of fingers 61 and reset cams 27, number wheels 21 are reset and springs 99 are stressed by top side 60 of member 59, whilst through engagement of abutment 93 and boss 91, the cam element 81 is partially reversed and the shaft 33 is pulled back under bias of spring 85 into groove 83 to complete the reversal of the cam during which motion the springs 99 carry through in contact with the bosses to keep the attitude of the pinions suitable for re-engagement. The pinions are thus re-engaged whilst the number wheels are held against movement in their re-set position and whilst springs 99 ensure correct re-meshing of the pinions. Button 67 is now released whereupon actuating member 65 returns under the bias of spring 69 and during its return movement jaw 73 engages abutment 63 and returns cradle 55 to its initial position so that springs 99 disengage bosses 53. The pawl 75 also re-engages ratchet 77 and the mechanism has accordingly been restored to its initial position suitable for a further counting and resetting cycle.

Whilst reorientation of the pinions and remeshing thereof in correct alignment has been described in connection with the engagement of springs 99 with bosses 53, it will be appreciated that features of the pinions other than bosses, indeed the pinion teeth themselves could be engaged by complementarily shaped springs or other flexible or flexibly mounted members.

The short stroke of actuating member 65 and consequent small extension of spring 69 together with the small displacement required for pinion shaft 33 and attendant small extension of spring 85 ensure power requirement for resetting of the counter is particularly small.

It should be noted as regards the power requirement for resetting that this is kept low by displacing the pinion shaft in a first part of the resetting action of the actuating member from the groove 83 to the periphery of cam element 81 and effecting zeroing of the number wheels in a second part of the resetting action during which since ratchet 77 and pawl 75 are disengaged power is not required to keep spring 85 extended. Thus the power requirement is not cumulatively increased during the resetting action.

We claim:

1. A resettable counting device comprising:

coaxial number wheels;

a reset cam provided with each number wheel to rotate therewith;

a transfer pinion shaft displaceable relatively to the number wheels;

transfer pinions rotatably mounted on said shaft and disposed respectively intermediate successive number wheels, each pinion during counting operations of the device meshing with gear teeth on one of the number wheels adjacent thereto and engaging drive means on the other number wheel during rotation of said other number wheel thereby partially to rotate said one of the number wheels;

a cradle having parallel end members extending transversely with respect to the number wheel axis, a longitudinal member connected therebetween, and first and second abutment means;

reset fingers supported on said longitudinal member of the cradle so as to be out of contact with the reset cams during counting operations and to be together rotatable about a common axis to engage respectively with the reset cams to reset the number wheels;

a reciprocably movable actuating member adapted during movement thereof in one sense to effect displacement of the transfer pinion shaft thereby to disengage the transfer pinions from the number wheels and subsequently to engage said first abutment means thereby rotating said reset fingers and adapted upon movement in the reverse sense to be repositioned for subsequent resetting operations; and flexible members disposed to be out of contact with the transfer pinions during counting operations and located so as to be engaged respectively by the transfer pinions subsequent to the disengagement thereof from the number wheels thereby to reorientate the transfer pinions, and so as to be engaged subsequently by said second abutment means upon rotation of the reset fingers, the engagement with the second abutment means serving to stress the flexible members so that contact between the pinions and the flexible members is maintained until remeshing of the pinions with the number wheels takes place, the flexible members thereafter disengaging from the pinions.

2. A counting device as claimed in claim 1 wherein said first abutment means is provided on the side of one of said end members remote from the longitudinal member and wherein the longitudinal member provides said second abutment means.

3. A counting device as claimed in claim 2, wherein the flexible members comprise a plurality of leaf springs secured on the body of the device and extending on the side of the transfer pinions remote from the number wheels.

4. A counting device as claimed in claim 2, characterised in that the axis of the end members of the cradle is coplanar with the axis of the number wheels.

5. A counting device as claimed in claim 2, characterised in that the transfer pinion shaft is spring biassed towards engagement of the pinions with the number wheels and means are provided which on displacement of the transfer pinion shaft during a first part of the resetting action of the actuating member so hold the shaft as to permit further movement of the actuating member unresisted by the spring biassing of the pinion shaft.

6. The counting device as claimed in claim 4, characterized in that the transfer pinion shaft is parallel with and rotatable with respect to the rotational axis of the cradle end members.

7. A counting device as claimed in claim 5, characterised in that the pinion shaft is carried in corresponding ends of arms which spaced from said corresponding ends are pivotally supported with respect to a common axis and the spring means which bias the pinion shaft comprise a helical spring which is connected at its ends respectively to one of said arms and to a central shaft on which the number wheels are mounted.

8. A counting device as claimed in claim 7, characterised in that the axes of rotation of the arms carrying the pinion shaft and of the cradle end member are coincident and are coplanar with the axis of the number wheels.

* * * * *